US006840173B2

(12) United States Patent
Kawabata et al.

(10) Patent No.: US 6,840,173 B2
(45) Date of Patent: Jan. 11, 2005

(54) PLATE CYLINDER AND PRINTING PLATE HOLDER FOR THE CYLINDER

(75) Inventors: Takanobu Kawabata, Yokohama (JP); Shinsuke Taira, Saitama (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 0 days.

(21) Appl. No.: 10/172,955

(22) Filed: Jun. 17, 2002

(65) Prior Publication Data

US 2003/0097946 A1 May 29, 2003

(30) Foreign Application Priority Data

Nov. 27, 2001 (JP) ..... 2001-360491

(51) Int. Cl.[7] ..... B41F 27/12
(52) U.S. Cl. ..... 101/415.1; 101/378
(58) Field of Search ..... 101/415.1, 378, 101/216, 248, DIG. 36

(56) References Cited

U.S. PATENT DOCUMENTS

| | | | | |
|---|---|---|---|---|
| 2,768,579 A | * | 10/1956 | Fies | 101/415.1 |
| 3,058,417 A | * | 10/1962 | Norlin | 101/415.1 |
| 3,095,811 A | * | 7/1963 | Peabody et al. | 101/415.1 |
| 3,456,588 A | * | 7/1969 | Brodie | 101/415.1 |
| 3,750,571 A | * | 8/1973 | Germann | 101/415.1 |
| 4,207,815 A | | 6/1980 | Watanabe | |
| 6,164,204 A | * | 12/2000 | Kawada et al. | 101/415.1 |
| 6,189,452 B1 | * | 2/2001 | Halup et al. | 101/415.1 |
| 2001/0050013 A1 | * | 12/2001 | Kawabata | 101/248 |

FOREIGN PATENT DOCUMENTS

| | | |
|---|---|---|
| JP | 5931467 | 8/1984 |
| JP | 2775850 | 5/1998 |

OTHER PUBLICATIONS

English translated abstracts of the above–referenced Japanese Application Nos. 2775850 and 59–31467.
European Search report dated Mar. 11, 2003 which issued in connection with corresponding European patent application.

* cited by examiner

*Primary Examiner*—Leslie J. Evanisko
(74) *Attorney, Agent, or Firm*—Trexler, Bushnell, Giangiorgi, Blackstone & Marr, Ltd.

(57) ABSTRACT

A plate cylinder and printing plate holder for the cylinder is provided, which is capable of adjusting relative positions of plural printing plate holders and fixing the printing plate holders on the plate cylinder without causing misalignments of images among printing plates held by the printing plate holders even after overprinting. A plate cylinder (2) is equipped with at least two printing plates (P) wrapped around the outer circumference thereof. The plate cylinder comprises printing plate holders (6, 7) provided each per printing plate (P) for holding the printing plates (P) on the outer circumference of the plate cylinder. The printing plate holders include one printing plate holder (6) provided in a stationary state and fixed against the plate cylinder and other printing plate holders (7) provided adjustable to move in the circumferential direction of the plate cylinder (2) and fixable against the plate cylinder.

13 Claims, 11 Drawing Sheets

PLATE CYLINDER AND PRINTING PLATE HOLDER FOR THE CYLINDER

CROSS-REFERENCE TO RELATED APPLICATION

This application is based on and claims the benefit of priority from prior Japanese Patent Application No. 2001-360491, filed on Nov. 27, 2001, the entire content of which is incorporated herein by reference.

BACKGROUND OF THE INVENTION

1. Field of the Invention

The present invention relates to a plate cylinder in a rotary press and a printing plate holder for holding a printing plate on the plate cylinder.

2. Description of the Related Art

A plate cylinder equipped with printing plates wrapped around the outer circumference thereof has been known in the art. The printing plates are fixed on the plate cylinder by means of printing plate holders. An example of such the plate cylinder is disclosed in Japanese Patent 2775850.

On the outer circumference of the plate cylinder disclosed in JP 2775850, plural attaching grooves extending parallel to the axial direction of the plate cylinder are provided in parallel with both the axial and circumferential directions. In each of these attaching grooves, a printing plate holder is provided per printing plate for holding a printing plate wrapped around the circumference of the plate cylinder.

The printing plate holder comprises a block and a printing plate engaging means. The block is fitted, secured and attached in the attaching groove. The block has a printing plate holding groove for hooking one folded end of the printing plate thereto. The printing plate engaging means is provided in the block for driving the other end of the printing plate, wrapped around the outer circumference of the plate cylinder, to be retracted always into the printing plate holding groove. The block is formed substantially in a rectangular parallelepiped shape and its top surface has a swell with the same diameter as that of the outer circumference of the plate cylinder. The printing plate holding groove is formed to have an opening along the longitudinal direction of the top surface of the block. The folded portion of the printing plate is hooked to an edge of the opening, in the longitudinal direction, at the rear in the rotational direction of the printing plate. The printing plate engaging means has a protrusion for engaging with the other end of the printing plate wrapped around the outer circumference of the plate cylinder and also has an shaft provided in the longitudinal direction of the block. The printing plate engaging means is configured to use a driving force imparted on the shaft to retract the other end of the printing plate always into the printing plate holding groove.

It is extremely difficult for JP 2775850 to process and assemble the printing plate holders provided in parallel with both the axial and circumferential directions of the plate cylinder without any substantial errors in terms of positional relations or positions of other printing plate holders relative to one printing plate holder. Accordingly, it is almost impossible to mass-produce plate cylinders that include the above two printing plate holders in position. The plate cylinder disclosed in JP 2775850 has an attaching groove formed in the outer circumference thereof for attaching a printing plate holder thereto, which is different from the plate cylinder. It is not effective, however, to correct relative positional relations of plural printing plate holders. Where overprinting such as multicolor printing is performed using a plurality of printing means equipped with such plate cylinders, although an overprinting alignment can be corrected by positioning a printing plate held by one printing plate holder on a plate cylinder in each printing means, positioning variations occur at locations of other printing plate holders. As a result, with respect to printing plates held by the other printing plate holders, overprinting errors corresponding to the above variations occur, resulting in a problem of print-failed pages.

On the other hand a technology for solving such the problem is disclosed in JP 59-31467B entitled "Split plate cylinder", for example. In this apparatus, the outer circumference of the plate cylinder is split into two in the axial direction. Then, one plate cylinder body receives the other cylindrical member having an identical outer diameter fitted therein rotatably in the circumferential direction and movable in the axial direction. This split plate cylinder employs position-adjusting means provided each for the plate cylinder body and the cylindrical member to adjust their positions in the circumferential and axial directions to eliminate overprinting alignments. However the conventional split plate cylinder is configured to perform individual position adjusting per split section in the circumferential and axial directions and further requires rotational driving per split section. This results in problems such as a complicated structure, an increased number of components, an elevated production cost and an inefficient maintenance operation.

If plural printing plate holders are provided along the circumferential direction of the plate cylinder, the split plate cylinder disclosed in JP 59-31467B can not adjust the positions of the printing plate holders each in the circumferential direction of the plate cylinder. Accordingly, it is not possible to correct variations in relative positions on processing and assembling of the printing plate holders. In addition, it is almost impossible to mass-produce plate cylinders with matched positional relations of holding printing plates. Plural printing means equipped with the plate cylinders can be employed to perform overprinting such as multicolor printing. In this case, an overprinting misalignment can be eliminated by positioning a printing plate held by one printing plate holder on a plate cylinder in each printing means. Even though, positioning variations occur at locations of other printing plate holdings. As a result, with respect to printing plates held by the other printing plate holders, overprinting errors corresponding to the above variations occur, resulting in a problem of print failures.

SUMMARY OF THE INVENTION

The present invention is intended to solve the above subjects in the prior art at once. It has an object to provide a plate cylinder and printing plate holder for the cylinder, which is capable of adjusting relative positions of plural printing plate holders and fixing the printing plate holders on the plate cylinder without causing misalignments of images among printing plates held on the printing plate holders even after overprinting.

To achieve the above object, the present invention is provided with a plate cylinder equipped with at least two printing plates wrapped around the outer circumference thereof, comprising: printing plate holders provided each per printing plate for holding said printing plates on the outer circumference of said plate cylinder, wherein one printing plate holder of said printing plate holders is provided in a stationary state and fixed against said plate cylinder, and other printing plate holders of said printing plate holders are provided adjustable to move in the circumferential direction of said plate cylinder and fixable against said plate cylinder.

According to the present invention, one printing plate holder is provided in a stationary state and fixed against the plate cylinder, and other printing plate holders are provided adjustable to move in the circumferential direction of the plate cylinder. Therefore, the printing plate holders, respectively provided for each of the printing plates to be held, can accurately correct relative positions of the printing plates in the circumferential direction of the plate cylinder.

In the plate cylinder according to the present invention, the printing plate holders may include two or more printing plate holders provided in the axial direction of the plate cylinder. Alternatively, the printing plate holders may include two or more printing plate holders provided in the circumferential direction of the plate cylinder. Further, the printing plate holders may include two or more printing plate holders provided in the axial direction of the plate cylinder and two or more printing plate holders provided in the circumferential direction of the plate cylinder.

Preferably, the plate cylinder according to the present invention may further comprise adjusting means for adjustably moving the plate cylinder in the axial and circumferential directions while the other printing plate holders are fixed against the plate cylinder. Arrangement of such the adjusting means can remove misalignments from overprinted image all at once and achieve a printing without any misalignment.

In the plate cylinder according to the present invention, the plate cylinder has an attaching groove formed in the outer circumference thereof and extending in parallel with the axial direction for attaching the printing plate holder therein. The other printing plate holders comprise a first gear operative in response to an external operation to rotate about an axis in the radial direction of said plate cylinder, a second gear mating with said first gear and operative in accordance with the rotation of said first gear to rotate about an axis in the direction parallel to the tangent of said plate cylinder, threaded rods provided integrally with rotary shafts at both sides of said second gear and having male screws formed at both ends, and a pair of pushers, each having a female screw formed to mate with said threaded rod, for moving in the direction parallel to the tangent of said plate cylinder relative to said printing plate holder body, to push either of both inner walls in said attaching groove in the circumferential direction of said plate cylinder. Gaps is formed between both sides of said other printing plate holders in the circumferential direction of said plate cylinder and said inner walls in said attaching groove in the circumferential direction of said plate cylinder. The threaded rods at both sides may have the same male screws formed thereon. In accordance with such the threaded rods threaded in the same direction, rotations of the first gear can be transmitted to the second gear. When the threaded rods rotate, the pair of pushers moves in the same direction and pushes the inner wall in the attaching groove. The resultant reaction moves the printing plate holder in the opposite direction relative to the pusher and corrects a position of the printing plate holder in the circumferential direction. The first and second gears such as a worm and worm wheel, a pair of bevel gears, and a rack and pinion in combination are used in the present invention.

The present invention is also provided with A printing plate holder for holding a printing plate wrapped around the outer circumference of a plate cylinder, comprising: a block having an edge for hooking one end of said printing plate thereto, said block attachable in an attaching groove formed in the outer circumference of said plate cylinder and extending in the direction parallel to the axial direction; printing plate engaging means for retracting the other end of said printing plate into said block; correcting means for correcting a position of said block relative to said plate cylinder in the circumferential direction; and fixing means for fixing said block in said attaching groove.

In the printing plate holder according to the present invention, the correcting means may comprise a first gear operative in response to an external operation to rotate about an axis in the radial direction of said plate cylinder, a second gear mating with said first gear and operative in accordance with the rotation of said first gear to rotate about an axis in the direction parallel to the tangent of said plate cylinder, threaded rods provided integrally with rotary shafts at both sides of said second gear and having male screws formed at both ends, and a pair of pushers, each having a female screw formed to mate with said threaded rod, for moving in the direction parallel to the tangent of said plate cylinder relative to said printing plate holder body, to push either of both inner walls in said attaching groove in the circumferential direction of said plate cylinder. Gaps is formed between both sides of said other printing plate holders in the circumferential direction of said plate cylinder and said inner walls in said attaching groove in the circumferential direction of said plate cylinder. The threaded rods at both sides may have the same male screws formed thereon.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 7:
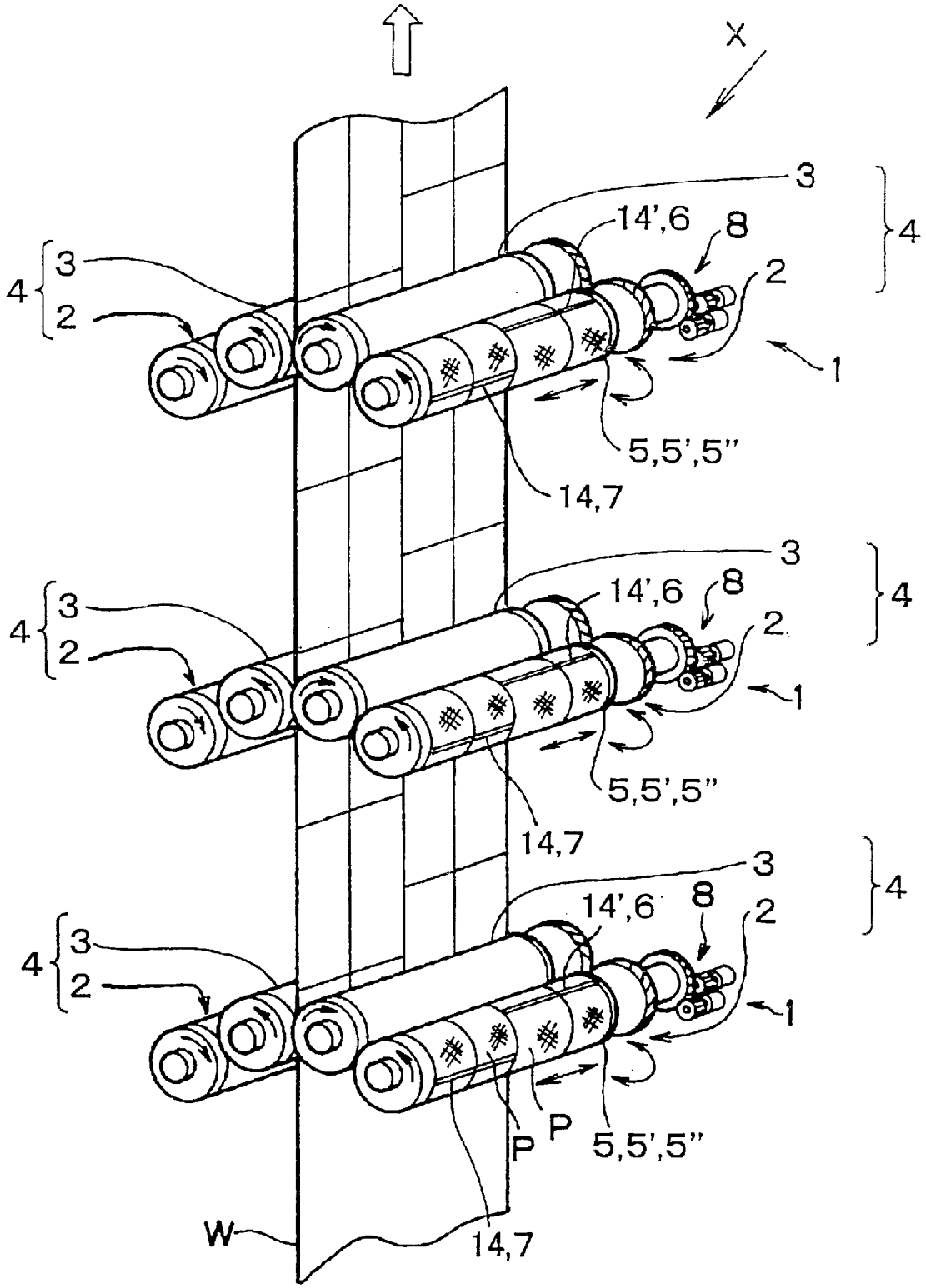
FIG. 7 is a schematic diagram showing plural printing means in a multicolor printer equipped with the plate cylinder according to the first embodiment.

A plate cylinder and printing plate holder for the cylinder according to the present invention will be described next with respect to a first embodiment. FIG. 7 is a schematic diagram showing plural printing means in a multicolor printer provided with the plate cylinder and printing plate holder for the cylinder according to the first embodiment. In FIG. 7 the reference numeral 1 denotes a plurality of printing units of a both-sided print (B—B) type provided along the running direction of a paper web W. Each printing unit 1 comprises a printing means 4 that includes a plate cylinder 2 and a blanket cylinder 3, which are provided in parallel and rotate synchronously, contacting the opposite outer circumferences with each other. The printing means 4 is provided with adjacent blanket cylinders 3, 3 that form a pair. The blanket cylinders 3, 3 contained in the printing means 4 are configured to print the web W that passes in between the blanket cylinders 3, 3 in a pair of opposite printing means 4, 4, using ink transferred from the printing plate P mounted on the plate cylinder 2.

Figure 1:
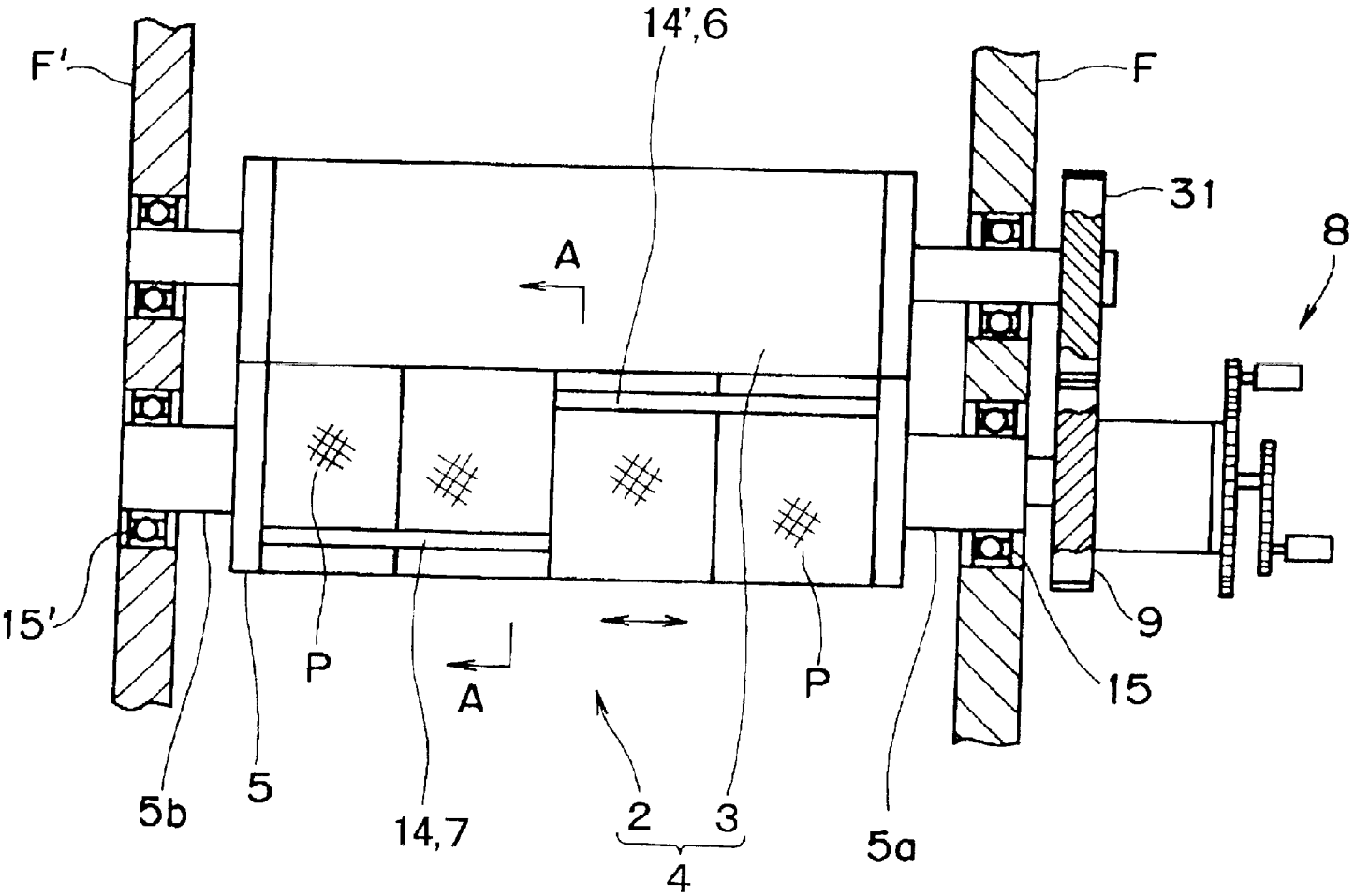
FIG. 1 is an outlined view of a printing unit provided with a first embodiment of a plate cylinder according to the present invention.
Figure 2:
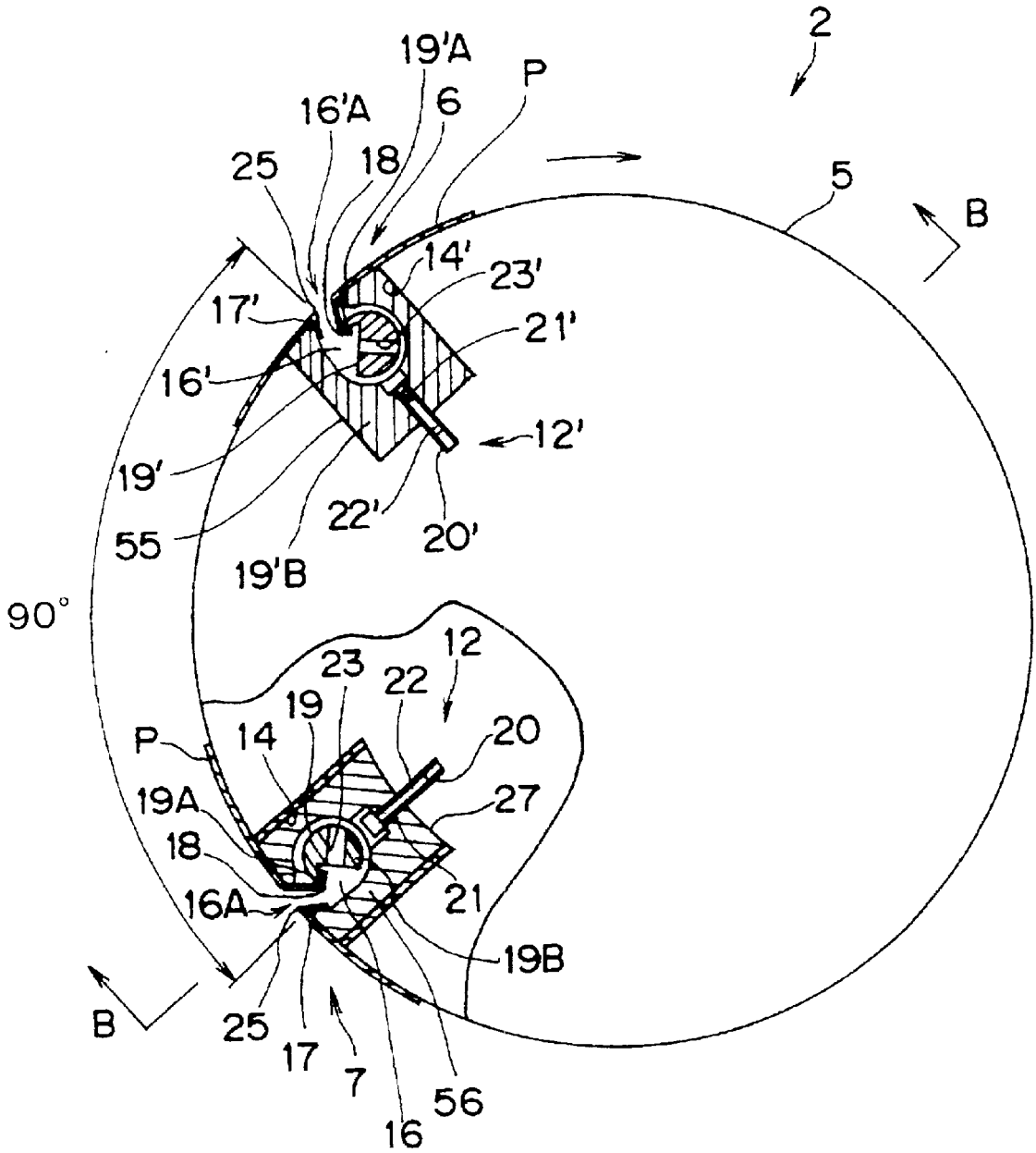
FIG. 2 is a cross-sectional view taken along the A—A line in FIG. 1.

The plate cylinder 2 provided in the printing means 4 comprises, as shown in FIGS. 1 and 2, a cylinder body 5, a first printing plate holder 6 which is stationary, and a second printing plate holder 7 movable in the circumferential direction of the plate cylinder 2 to correct its position. The plate cylinder 2 is supported on frames F, F' and provided with an adjusting means 8 and a first helical gear 9. Printing plates P are mounted on the plate cylinder and wrapped around the outer circumference thereof. Both ends of the printing plate P to be wrapped are folded toward inside the plate cylinder 2 to form folded portions 18, 25.

The cylinder body 5 has the outer circumference that is divided into two regions in the axial direction as shown in FIGS. 1 and 2. Attaching grooves 14, 14' are formed in parallel with the axis on the outer circumference between both ends of each region in the axial direction of the cylinder body 5. These attaching grooves 14, 14' are differently formed in phases by a predetermined angle shifted in the circumferential direction of the cylinder body 5. A first printing plate holder 6 is provided in one attaching groove 14' and a second printing plate holder 7 is provided in the other attaching groove 14. These first and second printing plate holders 6, 7 are employed to hold printing plates P, P wrapped around the outer circumference at each region. The other attaching groove 14 has a convex bottom formed about the axis of the cylinder body 5.

One axial end 5*a* of the cylinder body 5 is supported by one frame F through a bearing 15 rotatably and movable in the axial direction. A first helical gear 9 that is rotationally driven from a drive source, not depicted, is provided on the axial end 5*a*. A later-described adjusting means 8 for adjusting a position of the plate cylinder 2 in the axial and circumferential directions is provided on the tip of the axial end 5*a*. The other axial end 5*b* of the cylinder body 5 is supported on the frame F' through a bearing 15' rotatably and movable in the axial direction.

The first printing plate holder 6 comprises a block 55 attached in the attaching groove 14', which is formed in one of the two regions on the cylinder body 5, in a stationary state without any gaps in the circumferential direction of the cylinder body 5, a printing plate engaging means 19', and a fixing means 12' for fixing the block 55 in the attaching groove 14' of the cylinder body 5.

The block 55 is substantially formed in a rectangular parallelepiped shape having a length at least similar to the length of one side of the folded portion 25 of the printing plate P and having a height and width identical to that of the attaching groove 14' to tightly fit in the attaching groove 14' as shown in FIG. 2. The block 55 has a convex top surface formed about the axis of the cylinder body 5. The convex top surface has an opening 16'A and printing plate holding groove 16' for holding the printing plate P, which is formed so as to open and extend in the longitudinal direction. At least one of edges in the longitudinal direction of the opening 16'A serves as a printing plate holding edge 17' for hooking the folded portion 25 of the printing plate P. When the plate cylinder 2 operates on printing, the block 55 is fitted in the attaching groove 14' of the cylinder body 5 in a stationary state so as to locate the printing plate holding edge 17' at the rear in the rotational direction and secured to the cylinder body 5 by a fixing means 12' later described.

The printing plate engaging means 19' comprises a shaft 19'B provided in the printing plate holding groove 16' in the block 55 and means (not depicted) for imparting a force on the shaft 19'B to always pull the other end of the printing plate P into the printing plate holding groove 16'. The shaft 19'B has a protrusion 19'A hooked by the folded portion 18 at the other end of the printing plate P wrapped around the cylinder body 5. The shaft 19'B is formed in parallel with the longitudinal direction of the block 55. An appropriate number of through holes 23' are formed in the shaft 19'B along the axial direction of the cylinder body 5 to allow a bolt 22' of the fixing means 12' to pass through it. The through hole 23' is formed in the direction vertical to the axis of the shaft 19'B and has a diameter larger than the outer diameter of the head of the bolt 22'.

The fixing means 12' comprises an appropriate number of female screws 20' arranged along the axial direction of the cylinder body 5 on the bottom of the attaching groove 14' in the cylinder body 5, through holes 21' formed to pass through the printing plate holding groove 16' and bottom of the block 55, through holes 23' formed in the shaft 19'B of the printing plate holding means 19', and a bolts 22' inserted into the through hole 21' through the through holes 23' for mating with the female screws 20' to secure the block 55 in the cylinder body 5. These female screws 20', through holes 21' and through holes 23' are provided in the axial direction of the cylinder body 5 by an appropriate number so that they can match with each other, respectively. A tool 24 is inserted into the through hole 23' and operated to fasten the bolt 22'.

The second printing plate holder 7 comprises a block 56 attached in an attaching groove 14 formed in the other of the two regions on the cylinder body 5 and remaining a slight gap in the circumferential direction of the plate cylinder, a printing plate engaging means 19, a correcting means 11 for correcting the location of the block 56 relative to the cylinder body 5 in the circumferential direction, and a fixing means 12 for fixing the block 56 in the attaching groove 14 of the cylinder body 5.

The block 56 is substantially formed in a rectangular parallelepiped shape having a length at least identical to the length of one side at the folded portion 25 of the printing plate P, a height similar to and a width shorter than the attaching groove 14. The block 56 has a convex top surface formed about the axis of the cylinder body 5. The convex top surface has an opening 16A and printing plate holding groove 16 for holding the printing plate P, which is formed so as to open and extend in the longitudinal direction. At least one of edges in the longitudinal direction of the opening 16A serves as a printing plate holding edge 17 for hooking the folded portion 25 of the printing plate P. The block 56 has a concave surface on the bottom 27 formed about the axis of the cylinder body 5. When the plate cylinder 2 operates on printing, the block 56 is located in the attaching groove 14 of the cylinder body 5 so as to locate the printing plate holding edge 17 at the rear in the rotational direction, then subjected to correction of the attaching location by the correcting means 11, and secured to the cylinder body 5 by a fixing means 12 later described. After the block 56 is fixed in the cylinder body 5, a bulking agent of a dry hardening type is filled into the gap between the inner surface of the attaching groove 14 and the outer surface of the block 56. For example, the filler is a mixture of a main agent serving as the base material and a curing agent, which is employed in a pate state, having a trade name, "BONDOL", available from Nippon-Junyaku, Inc.

The printing plate engaging means 19 comprises a shaft 19B provided in the printing plate holding groove 16 of the block 56 and means (not depicted) for imparting a force on the shaft 19B to always pull the other end of the printing plate P into the printing plate holding groove 16. The shaft 19B has a protrusion 19A hooked by the folded portion 18 at the other end of the printing plate P wrapped around the cylinder body 5. The shaft is formed in parallel with the longitudinal direction of the block 56. An appropriate number of through holes 23 are formed in the shaft 19B along the axial direction of the cylinder body 5 to allow a bolt 22 of the fixing means 12 to pass through it. The through hole 23 is formed in the direction vertical to the axis of the shaft 19B and has a diameter larger than the outer diameter of the head of the bolt 22.

Figure 3:
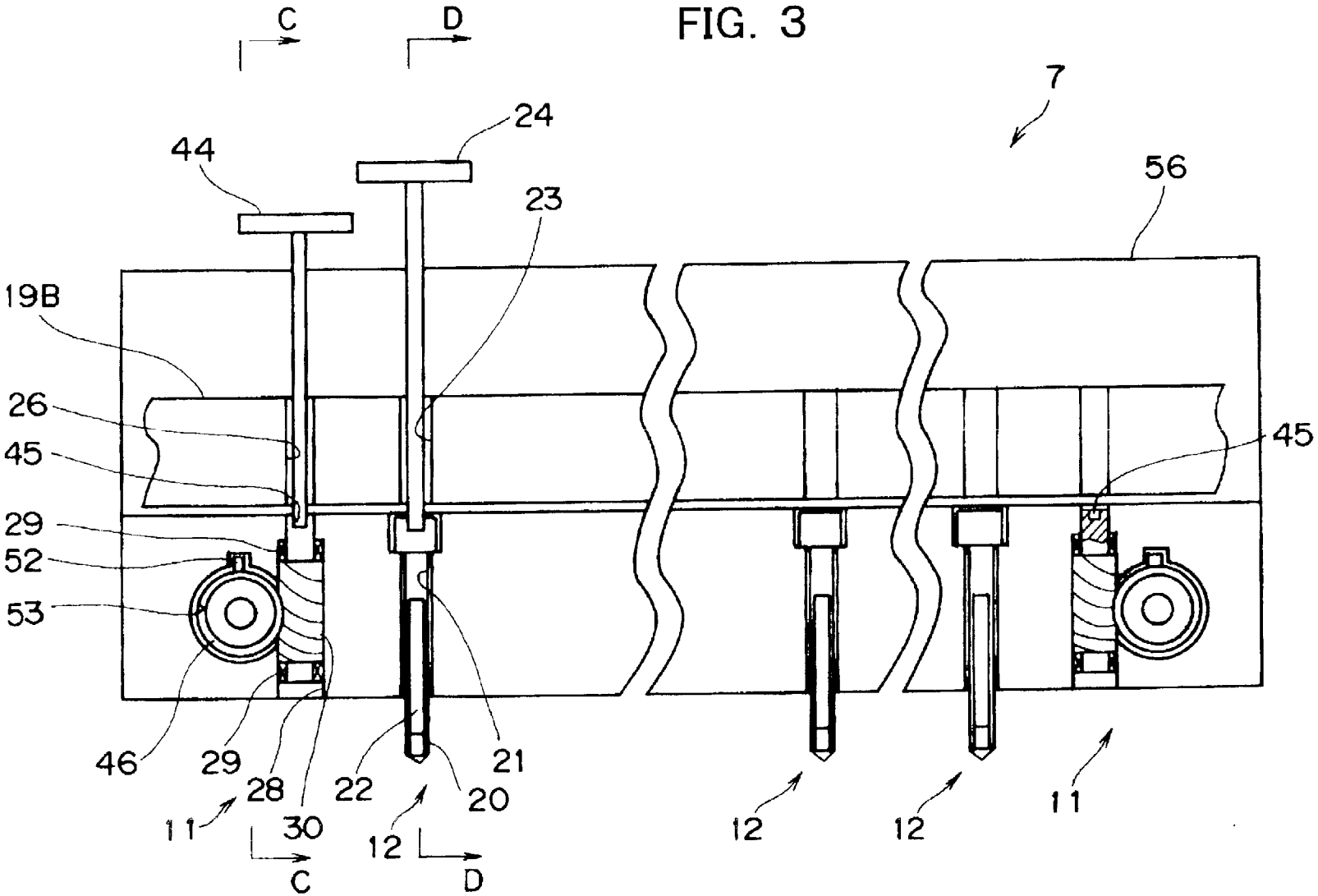
FIG. 3 is a cross-sectional view taken along the B—B line in FIG. 2.
Figure 4:
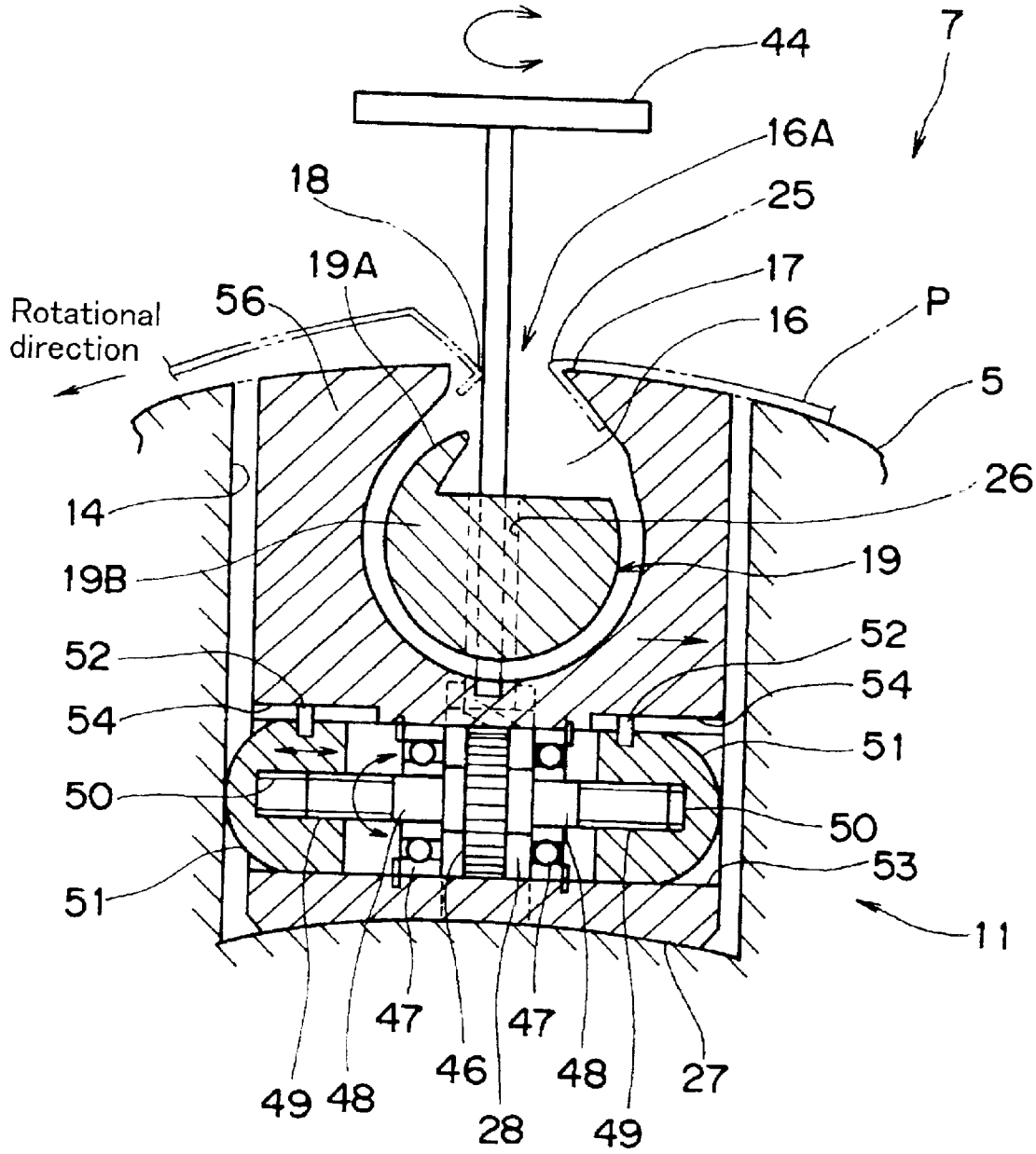
FIG. 4 is a cross-sectional view taken along the C—C line in FIG. 3.

As shown in FIGS. 3 and 4, the correcting means 11 comprises through holes 28, 28 formed in the vicinity of both ends of the block 56 in the longitudinal direction and passing from the printing plate holding groove 16 to the bottom 27 of the block 56, a worm 30 provided rotatably in the through hole 28, a through hole 53 partly overlapping the through hole 28 and passing through the block 56 in the direction vertical to the central axis of the through hole 28 and in the width direction of the block, a worm wheel 46 provided in the through hole 53 to mate with the worm 30 at right angle to receive rotations transmitted from the worm 30, shafts 48, 48 formed integrally with axles at both sides of the worm wheel 46, having male screws 49, 49 formed at the ends thereof, and pushers 51, 51 located at both sides of the worm wheel 46 in the through hole 53, having female screws 50, 50 formed therein for mating with the male screws 49, 49, respectively.

The worm 30 is rotatably supported by bearings 29, 29 provided in the through hole 28. A polygonal-sectioned bore 45 is formed in the upper portion of the worm 30 so that a tool 44 having a polygonal-shaped tip can be inserted into the bore 45 to rotate the worm 30. A through hole 26 formed in parallel with the through hole 23 for matching with the through hole 28 is formed in the shaft 19B. This through hole 26 is configured to allow the tool 44 to pass through it.

The worm wheel 46 is supported by bearings 47, 47 provided in the through hole 53. The male screws 49, 49 on the shafts 48, 48, provided at both sides of the worm wheel 46, are both male-threaded similarly.

A rotation stopper 52 is provided on the pusher 51, protruding outwardly in the radial direction of the cylinder body 5, to be inserted into a groove 54 formed along the through hole 53 in the block 56. The rotation stopper 52 has a function to prevent the pusher 51 from rotating as the male screw 49 rotates.

The tool 44 is inserted into the bore 45 at the upper portion of the worm 30 through the through hole 26 in the shaft 19B from the opening 16A. When the tool 44 is employed to rotate the worm 30, the rotation of the worm 30 is decelerated and transmitted to the worm wheel 46, which in turn rotates. When the worm wheel 46 rotates, the shafts 48, 48 at its both sides also rotate. At the same time, the pushers 51, 51, having the female screws 50, 50 formed thereon to mate with the male screws 49, 49 at the tip of the shafts 48, 48, slide along the groove 54 in the same direction to the left or right in FIG. 4. When the pushers 51, 51 slide, either of the pushers 51, 51 pushes either of the inner walls in the attaching groove 14. The resultant reaction force moves the block 56 oppositely, which is located in the attaching groove 14 of the cylinder body 5, remaining gaps therein. As the bottom of the attaching groove 14 and the bottom 27 of the block 56 are formed in convex or concave shape about the axis of the cylinder body 5, the block 56 can move along the bottom of the attaching groove 14 in the circumferential direction of the cylinder body 5. As the rotation of the worm 30 is decelerated and transmitted to the worm wheel 46, it is possible to slightly move and finely adjust the block 56 in the circumferential direction of the cylinder body 5. The moving direction of the block 56 can be altered when the tool 44 is rotated in the normal or reverse direction. The correcting means 11, 11, provided at both sides of the block 56 in the longitudinal direction, can perform this operation to correct the location of the block 56 relative to the cylinder body 5 in the circumferential direction.

Figure 5:
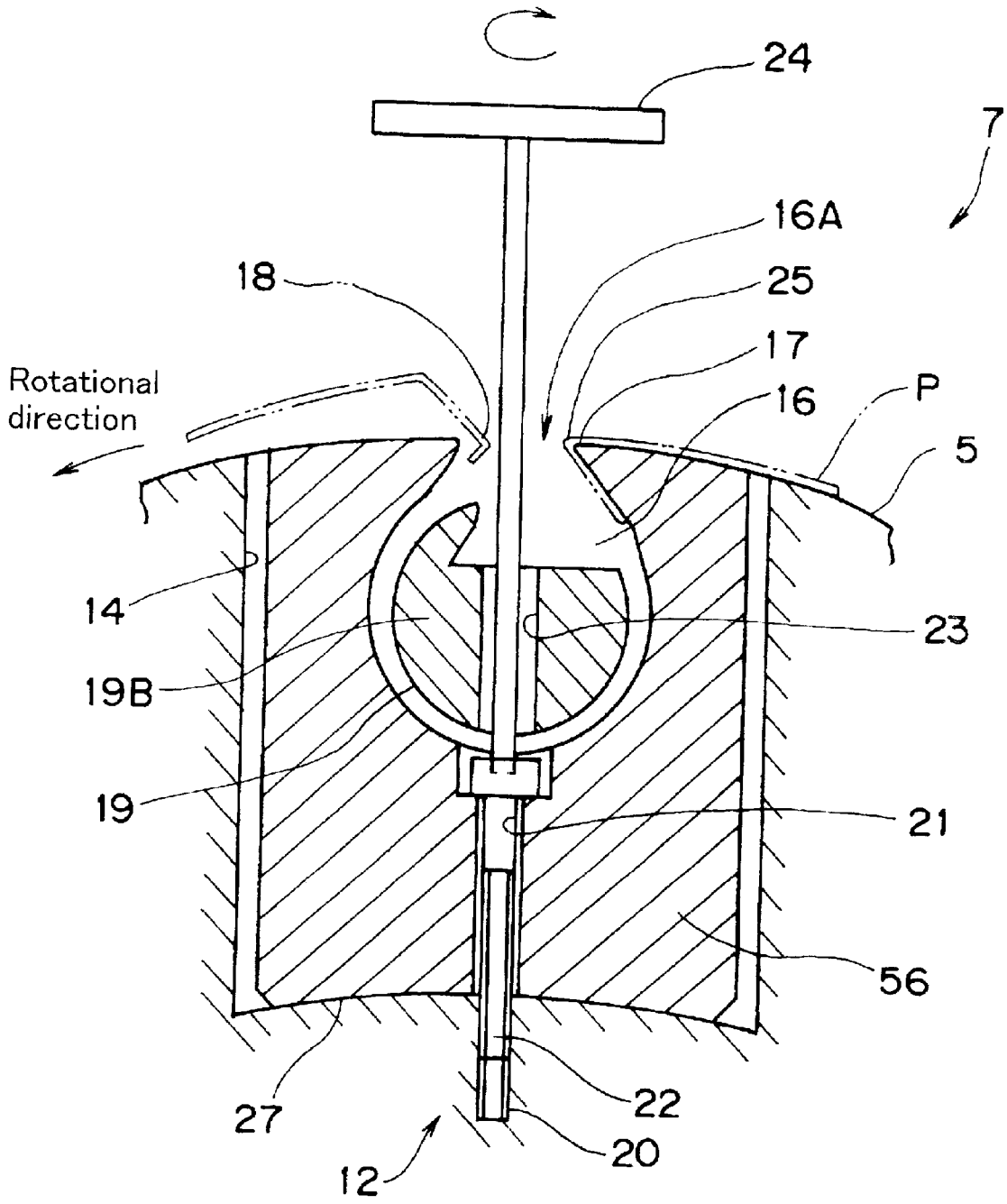
FIG. 5 is a cross-sectional view taken along the D—D line in FIG. 3.

As shown in FIG. 5, the fixing means 12 comprises an appropriate number of female screws 20 arranged along the axial direction of the cylinder body 5 on the bottom of the attaching groove 14 in the cylinder body 5, through holes 21 formed to pass through the printing plate holding groove 16 and bottom of the block 56, a through holes 23 formed in the shaft 19B of the printing plate holding means 19, and bolts 22 inserted into the through hole 21 through the through holes 23 for mating with the female screws 20 to secure the block 56 to the cylinder body 5. These female screws 20, through holes 21 and through holes 23 are provided in the axial direction of the cylinder body 5 by an appropriate number so that they can match with each other, respectively. A tool 24 is inserted into the through hole 23 in the shaft 19B from the opening 16A and operated to fasten the bolt 22. The through hole 21 is formed to match with the male screw 20 and larger than the screw diameter of the bolt 22. The through hole 23 is formed larger than the outer diameter of the head of the bolt 22 as described above. Therefore, the loosely fastened bolt 22 can allow the block 56 to move slightly in the circumferential direction of the cylinder body 5 on correction of the location.

The adjusting means 8 is provided to link with a rotary driver in the printing means 4. This rotary driver comprises a first helical gear 9 attached to the end 5*a* of the cylinder body 5, and a second helical gear 31 attached to the axle of the blanket cylinder 3 to mate with the first helical gear 9, and a transmission gear, not depicted, that mates with either of the first helical gears 9 and second helical gears 31. The first helical gear 9 is movable in the axial direction relative to the axial end 5*a* but restricted in the rotational direction. The adjusting means 8 is coupled to the first helical gear 9 and to the axial end 5*a* of the cylinder body 5.

Figure 6:
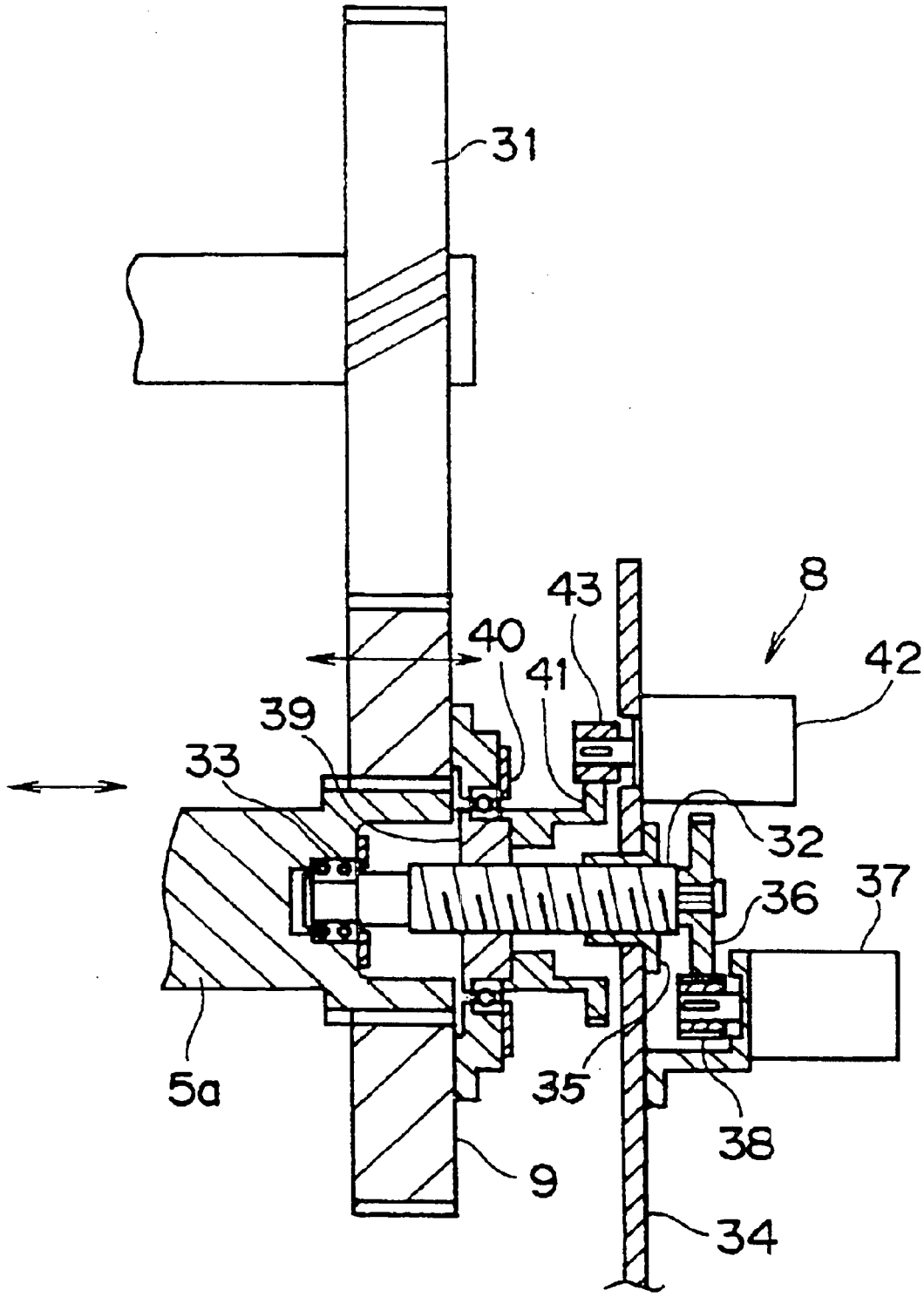
FIG. 6 is a cross-sectional view of adjusting means attached to the plate cylinder according to the first embodiment.

As shown in FIG. 6, the adjusting means 8 comprises a male-threaded rod 32 that is rotatably coupled to the tip of the axial end 5*a* through a bearing 33, extending in the axial direction, a stationary female-threaded member 35 fixed on a sub-frame 34 to mate with the threaded rod 32, a driven gear 36 fixed on the tip of the threaded rod 32, a drive gear 38 driven from a first motor 37 supported on the sub-frame 34 to mate with the driven gear 36, a rotary female-threaded member 39 mating with the threaded rod 32, coupled rotatably to the first helical gear 9 through a bearing 40, a driven gear 41 fixed on the rotary female-threaded member 39, and a drive gear 43 driven from a second motor 42 supported on the sub-frame 34 to mate with the driven gear 41.

The adjusting means 8 is configured to rotate the threaded rod 32 in the normal or reverse direction to displace the plate cylinder 2 forward or backward in the axial direction, when the first motor 37 is driven in the normal or reverse direction.

When the second motor 42 is driven in the normal or reverse direction, the rotary female-threaded member 39 rotates around the threaded rod 32 and moves in the axial direction. As a result, the first helical gear 9 displaces forward or backward in the axial direction and causes a phase difference in mating with the second helical gear 31, which can shift the rotational phase of the cylinder body 5 to the blanket cylinder 3.

Operation of the apparatus according to the first embodiment will be described below. Where a location of the printing plate holding edge 17 of the second printing plate holder 7 in the circumferential direction of the cylinder body 5 may be corrected relative to the printing plate holding edge 17' of the first printing plate holder 6, at first the location of the printing plate holding edge 17 of the second printing plate holder 7 is measured in the plate cylinder 2 relative to the location of the printing plate holding edge 17' of the first printing plate holder 6. This measured value is corrected next so as to meet with the predetermined reference value. Where the predetermined reference phase difference shown in FIG. 2 is assumed, for example, equal to 90°, a measured value of a distance on the outer circumference from the tip of the printing plate holding edge 17' of the first printing plate holder 6 to the tip of the printing plate holding edge 17 of the second printing plate holder 7 is compared with the reference value. This reference value is determined at the phase difference of 90° on the distance from the tip of the printing plate holding edge 17' of the first printing plate holder 6 to the tip of the printing plate holding edge 17 of the second printing plate holder 7 on the outer circumference. Then, correction is performed to match the measured value with the reference value.

This correction is performed as follows. First, as shown in FIGS. 3, 4 and 5, the tool 24 is passed through the opening 16A and the through hole 23 in the shaft 19B to engage with the head of the bolt 22 for use in securing the block 56 of the second printing plate holder 7. When the bolt 22 is rotated in an appropriate direction and loosened, the second printing plate holder 7 becomes movable in the circumferential direction of the cylinder body 5 within the attaching groove 14. Where the second printing plate holder 7 can be shifted in the circumferential direction of the cylinder body 5, for example, to the right in FIG. 4, the tool 44 passes through the through hole 26 in the shaft 19B to engage in the bore 45 at the upper portion of the worm 30. Then, it is rotated in an appropriate direction to transmit the rotation of the worm 30 to the worm wheel 46 to rotate the worm wheel 46. When the worm wheel 46 rotates, the shafts 48, 48 at both sides rotate. As a result, the pushers 51, 51, having the female screws 50, 50 mating with the male screws 49, 49 at the tips of the shafts 48, 48, slide to the left. Thus, the pusher 51 located at the left side in FIG. 4 pushes the inner left wall in the attaching groove 14. When this pusher 51 pushes the inner left wall in the attaching groove 14, the resultant reaction force displaces the block 56 of the second printing plate holder 7 to the right. As for the correcting means 11 at the opposite side in the longitudinal direction of the second printing plate holder 7, the location relative to the cylinder body 5 in the circumferential direction can be corrected similarly. When a measured value at a certain position meets with the reference value, the tool 24 is halted to rotate further at that position. In addition, the tool 44 is employed to fasten all bolts 22 in the fixing means 12, fixing the block 56 of the second printing plate holder 7 to the cylinder body 5. Finally, a dry-hardening bulking agent is filled in the gap between the inner wall of the attaching groove 14 and the outer surface of the block 56 so that the gap has the same outer diameter as the outer circumference of the cylinder body 5. The above correction is performed to all the plate cylinders 2.

In the printing means 4 at both sides of the web W passing through the printing unit 1, the plate cylinders 2, 2 each rotate oppositely. Therefore, the location of the printing plate holding edge 17 of the second printing plate holder 7 in the circumferential direction of the cylinder body 5 displaces oppositely relative to the printing plate holding edge 17' of the first printing plate holder 6.

With respect to the printing plate holding edge 17 of the second printing plate holder 7 relative to the printing plate holding edge 17' of the first printing plate holder 6, the above-described correction of the location of each plate cylinder 2 in the circumferential direction is performed at the time of assembling the printing unit 1. The second printing plate holder 7 is integrally fixed with the cylinder body 5 in that positional relation. Thereafter, the correction of the location of the printing plate holding edge 17 of the second printing plate holder 7 in the circumferential direction of each plate cylinder 2 relative to the printing plate holding edge 17' of the first printing plate holder 6 located at the time of assembling will be not be performed.

In a printer equipped with the printing means 4 that include the plate cylinders 2 all corrected as above, such as a multicolor printer shown in FIG. 7, the plate cylinders 2 in the printing means 4 at the same side of the web W have almost identical locations in the circumferential direction, with respect to the printing plate holding edge 17 of the second printing plate holder 7 relative to the printing plate holding edge 17' of the first printing plate holder 6.

The printing plates P are wrapped around the outer circumference of the two axial regions on the cylinder body 5 of the plate cylinder 2 and held by the printing plate engaging means 19' of the first printing plate holder 6 and the printing plate engaging means 19 of the second printing plate holder 7.

In the printing plates P to be held, print locations on pages and front and rear folded shapes are accurately created. Other means can be employed to position the printing plates P in the two axial regions on the plate cylinder 2 accurately along the axial direction, needless to say. This other means is omitted to describe, however, because it does not directly relate to the invention.

Printing is initiated after the printing plates P are held. Where the printer of FIG. 7 is employed, for example, to print the web W with multiple colors, overprinted images with each color may slightly misalign from one another. The misalignments in the printed images have the same direction and dimension in the two axial regions on the plate cylinder 2. Accordingly, it is required to eliminate misalignments among one and others in the plural overprinting images. Thus, the plate cylinders 2 equipped with the printing plates P of the other print images are shifted and adjusted in either or both of the axial and circumferential directions using the adjusting means 8 individually provided. This adjustment can move the plate cylinder 2, that is, the first printing plate holder 6 and the second printing plate holder 7 arranged in the two axial regions on the cylinder body 5 integrally with the cylinder body 5. This is effective to remove misalignments among printing plate images on the printing plates P, P in the two axial regions on the plate cylinder 2 all at once.

As described above, in the cylinder bodies 5 of the plate cylinders 2 in the printing means 4 for use in printing the same side of the web W, with respect to the printing plate holding edge 17 of the second printing plate holder 7 relative to the printing plate holding edge 17' of the first printing plate holder 6, the relative locations in the circumferential direction of the cylinder body 5 are equally set in all the printing means 4. In this condition, they are fixed to integrate the cylinder body 5 with the first printing plate holder 6 and the second printing plate holder 7 that is location-corrected in the circumferential direction of the cylinder body 5. The adjusting means 8 in the plate cylinders 2 are employed to adjust phases in the axial and circumferential directions integrally. This is effective to print overprinted images without misalignments in both the two print regions split in the axial direction of the cylinder body 5.

Figure 8:
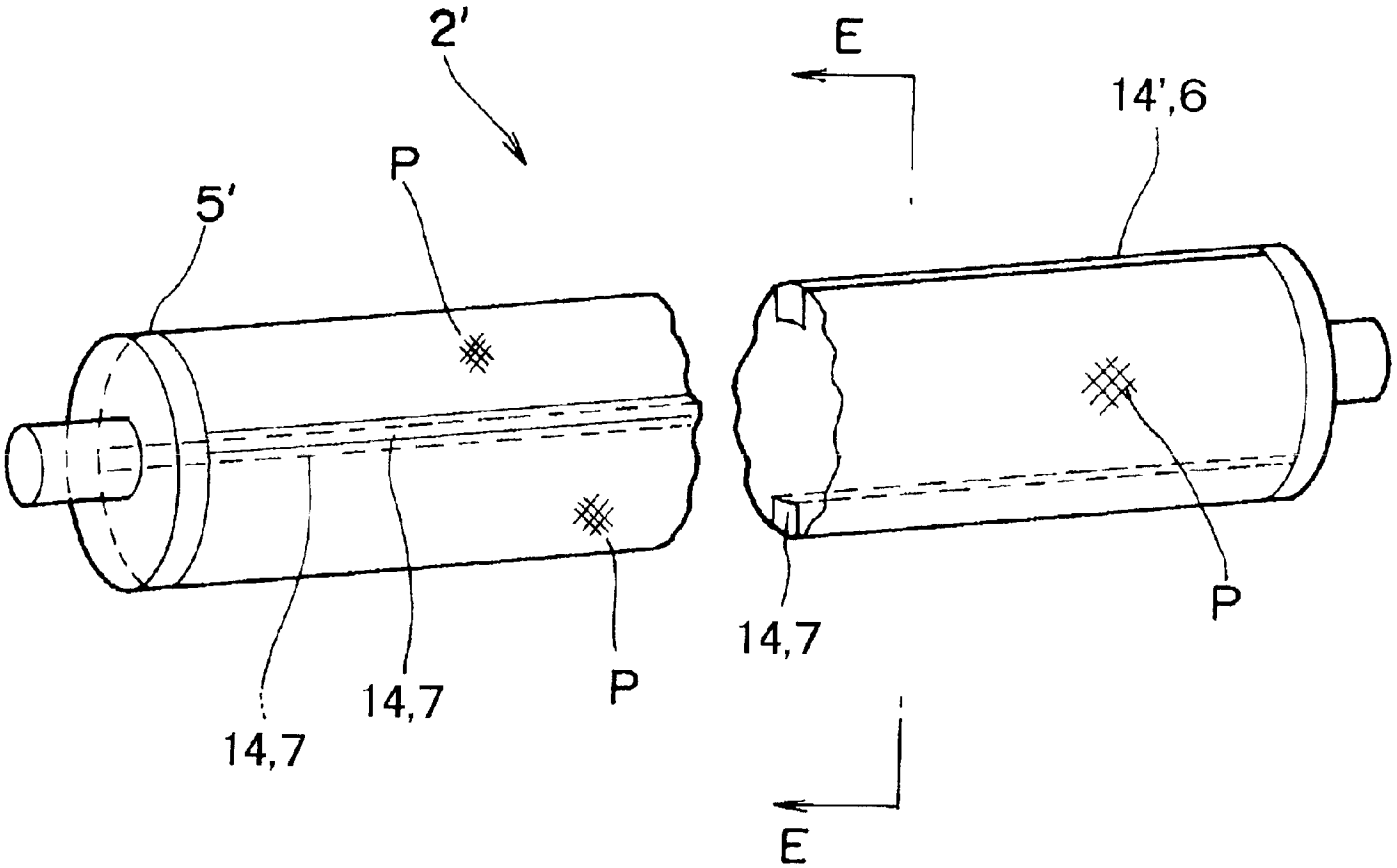
FIG. 8 is an outlined perspective view of a plate cylinder according to a second embodiment of the present invention.
Figure 9:
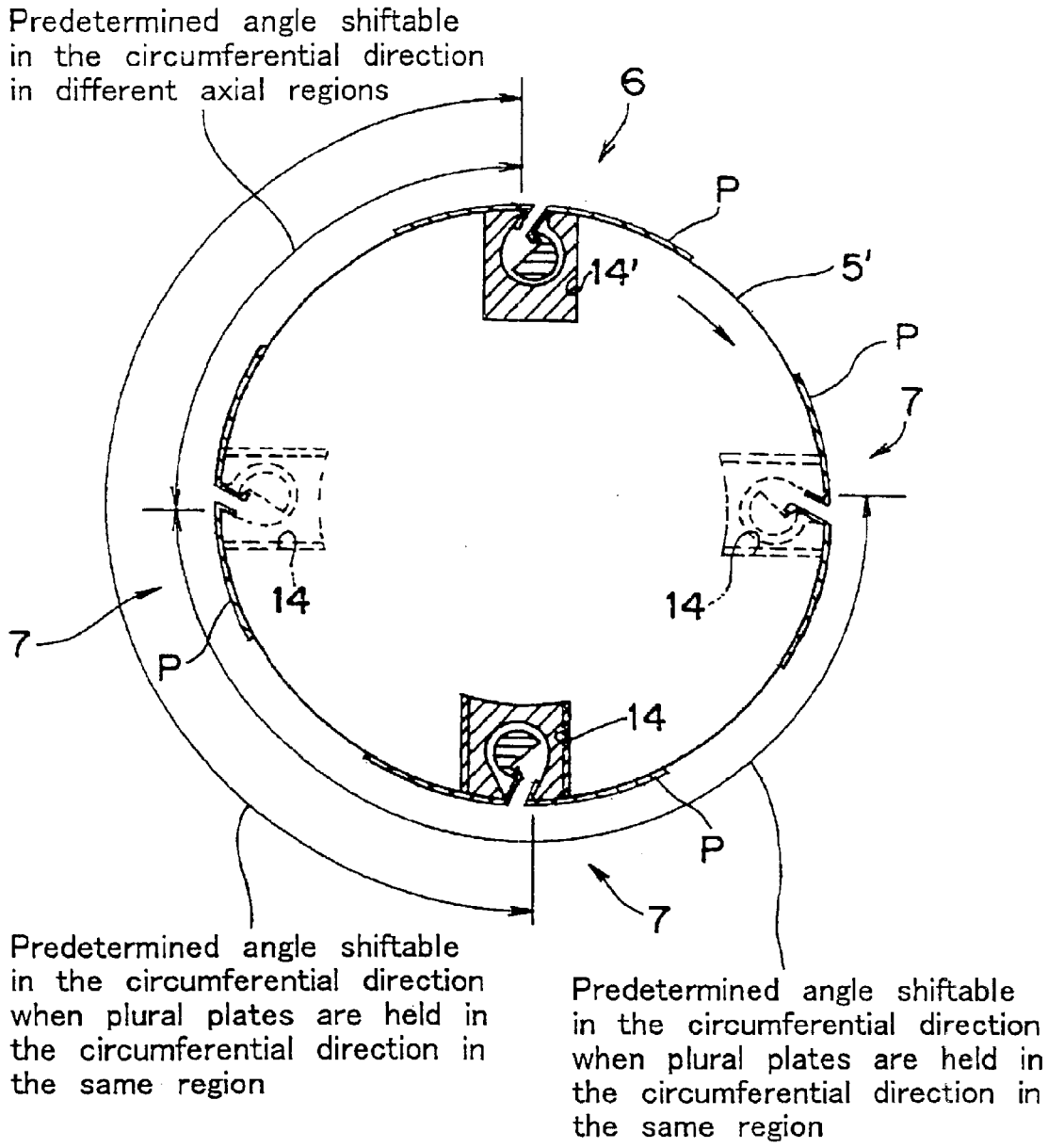
FIG. 9 is a cross-sectional view taken along the E—E line in FIG. 8.

A second embodiment of a plate cylinder according to the present invention will be described next with reference to FIGS. 8 and 9, in which the same components as those in the first embodiment are indicated with the same reference numerals. A cylinder body 5' according to the second embodiment has two regions split in the axial direction on the outer circumference similar to the cylinder body according to the first embodiment. One of the regions has an attaching groove 14' for attaching the first printing plate holder 6 stationary and an attaching groove 14 for attaching the second printing plate holder 7 at an adjustable location in the circumferential direction, provided with a phase difference of a predetermined angle, for example, 180°. The other region has attaching grooves 14 for attaching the second printing plate holders 7 at adjustable locations in the circumferential direction, provided with a phase difference of a predetermined angle, for example, 180°. This is a different point from the first embodiment. In the plate cylinder according to the second embodiment, two printing plates are mounted on one region and four printing plates totally. The attaching grooves 14, 14' provided in one region and the attaching grooves 14, 14 provided in the other region have a phase difference of a predetermined angle, for example, 90° therebetween.

Figure 10:
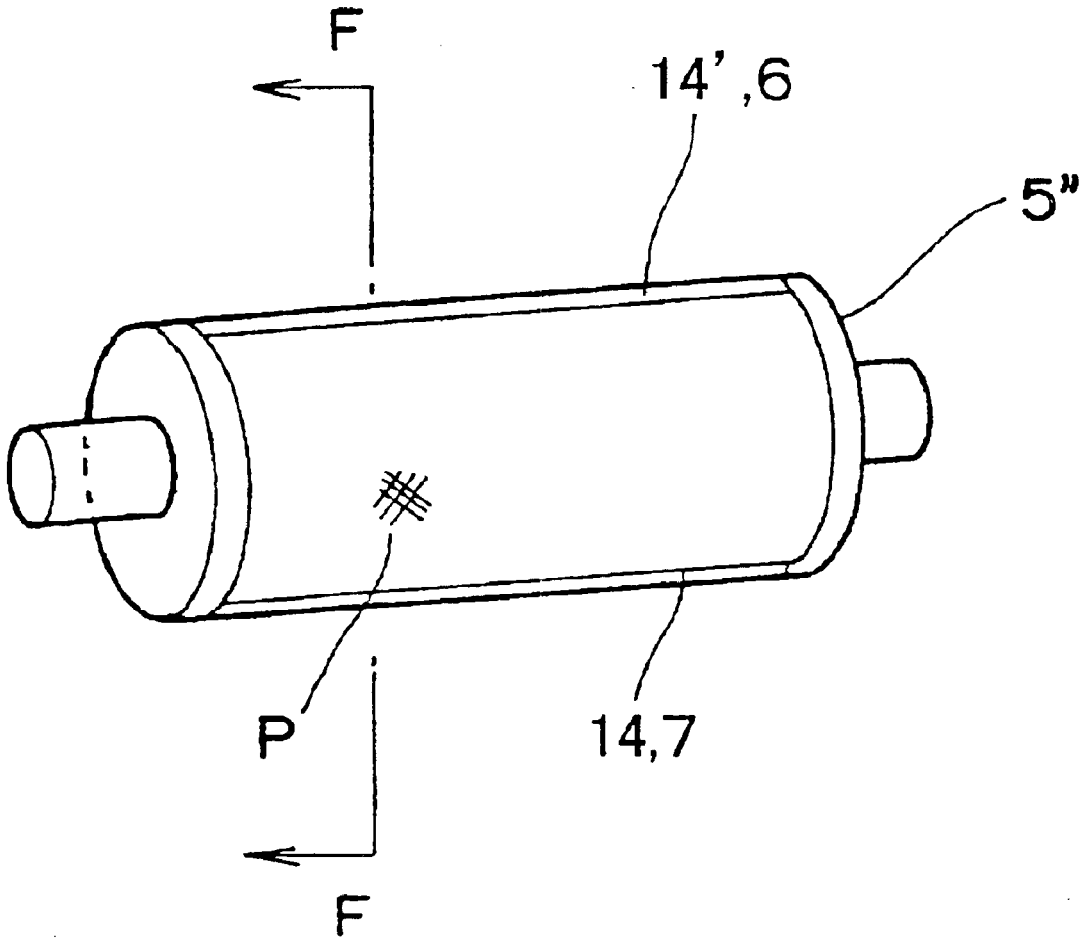
FIG. 10 is an outlined perspective view of a plate cylinder according to a third embodiment of the present invention.
Figure 11:
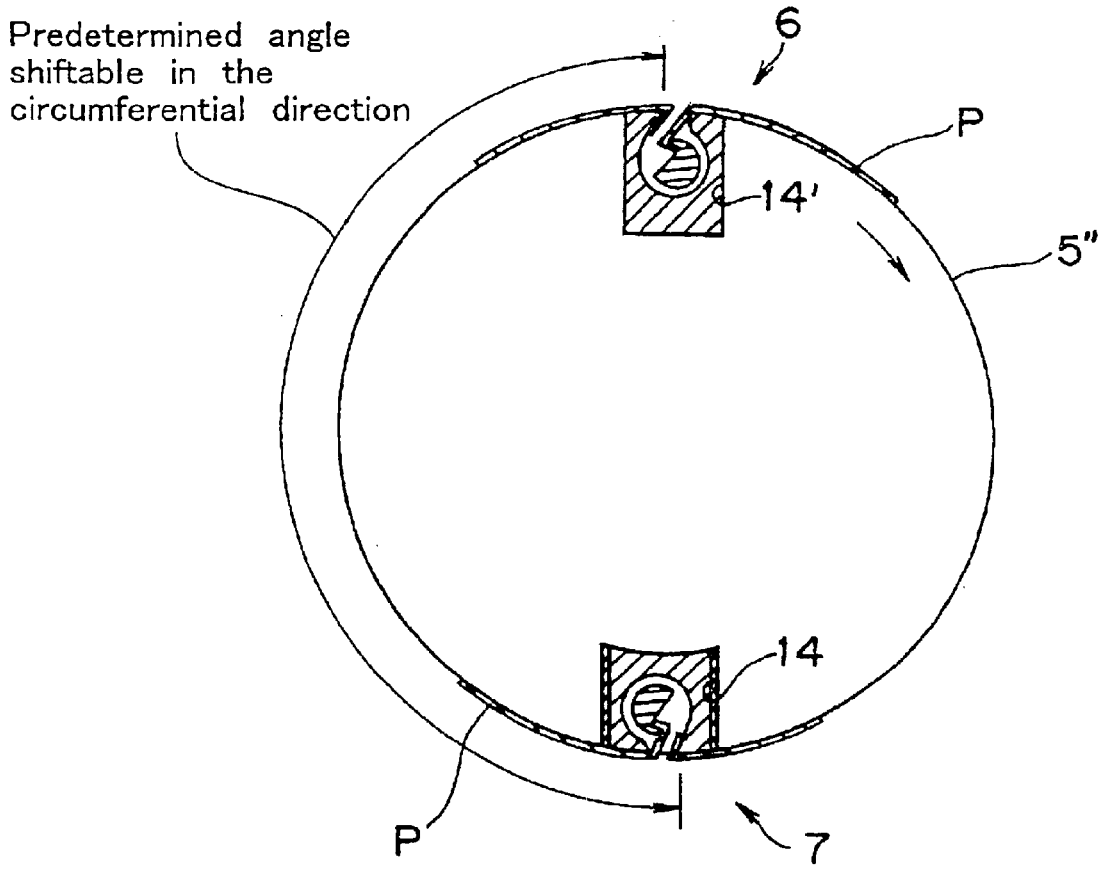
FIG. 11 is a cross-sectional view taken along the F—F line in FIG. 10.

A third embodiment of a plate cylinder according to the present invention will be described next with reference to FIGS. 10 and 11, in which the same components as those in the first embodiment are indicated with the same reference numerals. A cylinder body 5" according to the third embodiment is not split into two regions in the axial direction on the outer circumference. Rather, an attaching groove 14' for attaching the first printing plate holder 6 stationary and an attaching groove 14 for attaching the second printing plate holder 7 at an adjustable location in the circumferential direction are provided with a phase difference of a predetermined angle, for example, 180° on a single region in the outer circumference. This is a different point from the first embodiment. The plate cylinder according to the third embodiment is configured to mount two plates (cylinders) on a single region formed in the outer circumference.

The first, second and third embodiments may have an additional configuration to provide one correcting means (not depicted) for pushing only one of the inner walls in the attaching groove 14 and another correcting means (not depicted) for pushing only the other of the inner walls in the attaching groove 14 in parallel in the vicinity of each of both ends of the block 56 in the longitudinal direction. When a pusher (not depicted) pushes the inner left wall in the attaching groove 14, for example, the one correcting means shifts the block 56 to the right with the resultant reaction force. When a pusher (not depicted) pushes the inner right wall in the attaching groove 14, the other correcting means shifts the block 56 to the left with the resultant reaction force. The configuration of the above-described correcting means 11 may be employed to configure the one correcting means and the other correcting means. In either case, when the one correcting means is employed to shift the block 56 in the circumferential direction of the cylinder body 5, it is required to form a gap between the pusher 51 in the other correcting means and the opposite inner wall in the attaching groove 14.

In the first, second and third embodiments, instead of the combination of the worm 30 and worm wheel 46, a pair of bevel gears or a combination of rack-and-pinion may be utilized. In the case of the pair of bevel gears, instead of the worm 30 and worm wheel 46, bevel gears are employed. Male screws are provided at the axial tips at both sides of the bevel gear that is the replacement for the worm wheel 46 and receives rotations transmitted almost at right angle. Rotations of the male screws can linearly slide the pusher that mates with the male screw to push the inner wall in the attaching groove with the end of the pusher, moving the block in the circumferential direction of the cylinder body and correcting the location (not depicted). In the case of the combination of rack-and-pinion, the pinion, provided as the replacement for the worm 30, is employed to mate with the rack almost vertically. When the pinion is rotated to move the rack linearly, the end of the rack pushes the inner wall in the attaching groove and moves the block in the circumferential direction of the cylinder body 5 to correct the location thereof (not depicted).

In the first, second and third embodiments, the first printing plate holder 6 is located fixedly in the circumferential direction of the cylinder bodies 5, 5', 5" and the second printing plate holder 7 is located adjustably in the circumferential direction of the cylinder bodies 5, 5', 5". Alternatively, all the cylinder bodies 5, 5', 5" may include the second printing plate holders 7 movable in the circumferential direction. On correction of locations, one of the second printing plate holders 7 is fixed as the reference and the others are located adjustably in the circumferential direction of the cylinder bodies 5, 5', 5".

As obvious from the forgoing, according to the present invention, plural printing plate holders each for holding a printing plate are located in either or both of the axial and circumferential directions on the outer circumference of a plate cylinder. One of these printing plate holders is provided fixedly in a stationary state and others are provided adjustably movable in the circumferential direction on the plate cylinder. Thus, it is possible to accurately correct the relative position of the printing plate, which is held by the printing plate holder individually provided, in the circumferential direction of the printing plate.

The printing plate holder fixed on the plate cylinder accurately corrected and the printing plate holder at the location corrected in the circumferential direction of the plate cylinder can be fixed integrally with the plate cylinder for use in printing. Therefore, it is possible to remove misalignments from the overprinted images all at once to achieve prints without misalignment only using a set of adjusting means provided for adjusting in the axial and circumferential directions. The use of only one set of the adjusting means can provide the printing means with a decreased number of components, a lowered cost and easy maintenance.

Plural printing plates can be held on the plate cylinder in the circumferential direction to create a printed image without misalignment. Accordingly, the length of the printing plate in the circumferential direction of the plate cylinder can be shortened and the printing plate can be easily transported and held on the plate cylinder.

Having described the embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A plate cylinder equipped with at least two printing plates wrapped around the outer circumference thereof, comprising:

printing plate holders provided each per printing plate for holding said printing plates on the outer circumference of said plate cylinder, wherein one printing plate holder of said printing plate holders is provided in a stationary state and fixed against said plate cylinder, and other printing plate holders of said printing plate holders are provided adjustable to move in the circumferential direction of said plate cylinder and fixable against said plate cylinder, wherein said plate cylinder has an attaching groove formed in the outer circumference thereof and extending in parallel with the axial direction for attaching said printing plate holder therein, said other printing plate holders comprising a first gear operative in response to an external operation to rotate about an axis in the radial direction of said plate cylinder, a second gear mating with said first gear and operative in accordance with the rotation of said first gear to rotate about an axis in the direction parallel to the tangent of said plate cylinder, threaded rods provided integrally with rotary shafts at both sides of said second gear and having male screws formed at both ends, and a pair of pushers, each having a female screw formed to mate with said threaded rod, for moving in the direction parallel to the tangent of said plate cylinder relative to said printing plate holder body, to push either of both inner walls in said attaching groove in the circumferential direction of said plate cylinder, wherein gaps are formed between both sides of said other printing plate holders in the circumferential direction of said plate cylinder and said inner walls in said attaching groove in the circumferential direction of said plate cylinder, and said threaded rods at both sides have the same male screws formed thereon.

2. The plate cylinder according to claim 1, wherein said printing plate holders include two or more printing plate holders provided in the axial direction of said plate cylinder.

3. The plate cylinder according to claim 1, wherein said printing plate holders include two or more printing plate holders provided in the circumferential direction of said plate cylinder.

4. The plate cylinder according to claim 1, further comprising adjusting means for adjustably moving said plate cylinder in the axial and circumferential directions while said other printing plate holders are fixed against said plate cylinder.

5. A printing plate holder for holding a printing plate wrapped around the outer circumference of a plate cylinder, comprising:

a block having an edge for hooking one end of said printing plate thereto, said block attachable in an attaching groove formed in the outer circumference of said plate cylinder and extending in the direction parallel to the axial direction;

printing plate engaging means for retracting the other end of said printing plate into said block;

correcting means for correcting a position of said block relative to said plate cylinder in the circumferential direction; and fixing means for fixing said block in said attaching groove, wherein said correcting means comprises a first gear operative in response to an external operation to rotate about an axis in the radial direction of said plate cylinder, a second gear mating with said first gear and operative in accordance with the rotation of said first gear to rotate about an axis in the direction parallel to the tangent of said plate cylinder, threaded rods provided integrally with rotary shafts at both sides of said second gear and having male screws formed at both ends, and a pair of pushers, each having a female screw formed to mate with said threaded rod, for moving in the direction parallel to the tangent at said plate cylinder relative to said printing plate holder body, to push either of both inner walls in said attaching groove in the circumferential direction of said plate cylinder, wherein gaps are formed between both sides of said other printing plate holders in the circumferential detection of said plate cylinder and said inner walls in said attaching groove in the circumferential direction of said plate cylinder, and said threaded rods at both sides have the same male screws formed thereon.

6. A plate cylinder having an outer circumference, said plate cylinder comprising: at least one printing plate wrapped around the outer circumference of the plate cylinder and having a first end and a second end; and a printing plate holder configured to engage both ends of the printing plate and configured to be adjustable such that positions of both ends of the printing plate are adjustable relative to a circumferential direction of the outer circumference of the plate cylinder; further comprising a second printing plate wrapped around the outer circumference of the plate cylinder and having a first end and a second end, and a second printing plate holder configured to engage both ends of said second printing plate and configured such that at least one of the first end and the second end are stationary relative to a circumferential direction of the outer circumference of the plate cylinder.

7. The plate cylinder according to claim 6, wherein said first printing plate holder and said second printing plate holder are provided in the axial direction of said plate cylinder.

8. The plate cylinder according to claim 6, further comprising adjusting means for adjustably moving said plate cylinder in the axial and circumferential directions while said printing plate holders are fixed against said plate cylinder.

9. A plate cylinder equipped with at least two printing plates wrapped around the outer circumference thereof, comprising:

printing plate holders provided each printing plate for holding said printing plates on the outer circumference of said plate cylinder, wherein one printing plate holder of said printing plate holders is configured to engage ends of a first printing plate and is provided in a stationary state and fixed against said plate cylinder, and other printing plate holders of said printing plate holders are configured to engage ends of other printing plates and are provided adjustable to move respective printing plates in the circumferential direction of said plate cylinder and fixable against said plate cylinder.

10. The plate cylinder according to claim 9, wherein said printing plate holders include two or more printing plate holders provided in the axial direction of said plate cylinder.

11. The plate cylinder according to claim 9, further comprising adjusting means for adjustably moving said plate cylinder in the axial and circumferential directions while said other printing plate holders are fixed against said plate cylinder.

12. A plate cylinder having an outer circumference, said plate cylinder comprising: a plurality of printing plates wrapped around the outer circumference of the plate cylinder; and a printing plate holder comprising a holding edge configured to hook a folded portion at an end of one printing plate and a protrusion configured to hook a folded portion at an end of another printing plate the printing plate holder being adjustable such that positions of the ends of the printing plates are adjustable relative to a circumferential direction of the outer circumference of the plate cylinder.

13. A plate cylinder having an outer circumference, said plate cylinder comprising: a plurality of printing plates wrapped around the outer circumference of the plate cylinder; and a printing plate holder configured to engage an end of one printing plate and an end of another printing plate and is provided in a stationary state and fixed against said plate cylinder, and other printing plate holders, each of said other printing plate holders configured to engage an end of one printing plate and an end of another printing plate, wherein said other printing plate holders are provided adjustable to move respective printing plates in the circumferential direction of said plate cylinder and fixable against said plate cylinder.

* * * * *

UNITED STATES PATENT AND TRADEMARK OFFICE

CERTIFICATE OF CORRECTION

PATENT NO. : 6,840,173 B2 
DATED : January 11, 2005
INVENTOR(S) : Takanobu Kawabata and Shinsuke Taira It is certified that error appears in the above-identified patent and that said Letters Patent is hereby corrected as shown below:

Column 14,
Line 61, "each printing" should read -- each per printing --

Signed and Sealed this

Seventh Day of June, 2005

JON W. DUDAS
*Director of the United States Patent and Trademark Office*